United States Patent [19]

Hong

[11] Patent Number: 4,637,325

[45] Date of Patent: Jan. 20, 1987

[54] SECURITY CASE USED ON COUNTER

[76] Inventor: Chung-Yieh Hong, No. 9, Lane 493, Yen Pin I Road, Ku San Li, Chi San Cheng, Kao Hsiung Hsien, Taiwan

[21] Appl. No.: 763,545

[22] Filed: Aug. 7, 1985

[51] Int. Cl.[4] ..... E06B 7/32; E05G 1/00; E04B 1/346

[52] U.S. Cl. ..... 109/19; 109/48; 52/31; 52/65

[58] Field of Search ..... 52/31, 65; 109/4, 6, 109/19, 48; 49/40, 42, 70; 312/33, 196

[56] References Cited

U.S. PATENT DOCUMENTS

| | | | |
|---|---|---|---|
| 226,759 | 4/1880 | Krebs | 52/31 |
| 1,335,601 | 3/1920 | Povey | 109/19 |
| 1,885,560 | 11/1932 | Hassey | 109/19 |

FOREIGN PATENT DOCUMENTS

| | | | |
|---|---|---|---|
| 2346542 | 10/1977 | France | 109/48 |

*Primary Examiner*—James L. Ridgill, Jr.

*Attorney, Agent, or Firm*—Knobbe, Martens, Olson & Bear

[57] ABSTRACT

A security case adapted to be disposed on a counter of a bank, which comprises a housing having at least one security closet at its upper portion and aligned front and rear openings at the front side and at the rear side of the lower portion of the housing. At least one rotary container is mounted in the housing between the front and rear openings for rotation about a vertical axis, and is provided with an opening to allow banking documents access to the container, the container conveying the documents from the front side to the rear side of the counter. A transparent cover is disposed for covering a portion of the openings of the housing for allowing a view to the front side from the rear side of the counter.

3 Claims, 2 Drawing Figures

SECURITY CASE USED ON COUNTER

BACKGROUND OF THE INVENTION

This invention relates to a security case adapted to be disposed on a counter of a banking house, and particularly to a security case through which the bank official and the customer can make their transaction.

Curretly-used counters in banks are generally of the open type so that it is convenient for the customer to communicate with the bank official. However, in some cases, such an open type counter is unsafe, because it is easy for a robber to attack the bank official or to accomplish his intention.

SUMMARY OF THE INVENTION

An object of the invention is to provide a security case which is adapted to be placed on a counter for protection against robbery, and through which the customer can communicate with the bank official. This and other objects can be achieved in accordance with the invention through the provision of a security case which comprises: a housing having a front opening and a rear opening aligned with the front opening; at least one container mounted in the housing for rotation about a vertical axis between the front and rear openings, said container having at least one access opening; and a transparent cover means disposed in the housing for covering at least one portion of the front opening or the rear opening.

According to one aspect of the invention, the housing includes a top panel, a bottom panel, two vertical side panels interconnecting the top and bottom panels, at least one shelf disposed between the top and bottom panels, a front panel having four sides connected to the top panel, the side panels and the shelf for covering the front side of the upper portion of the housing above the shelf. At least one door is provided at the rear side of the housing for covering the compartment which is confined by the shelf, the front panel, the top panel and two side panels. The front opening and the rear opening are defined by the shelf, the side panels and the bottom panel at the front side and the rear side of the housing.

According to another aspect of the invention, the container is mounted on the bottom panel and has a bottom and a cylindrical wall, said wall being provided with two diametrically opposite access openings and a diametral cross partition member between the access openings. The top side of the container is spaced apart from the bottom side of the shelf and the transparent cover is disposed in the housing between the shelf and the top side of the container.

According to a further aspect of the invention, the housing may further include a vertical partition member between the side panels, the top and the bottom edges of the partition member being connected to the top panel and the bottom panel.

The present exemplary preferred embodiment will be described in detail with reference to the following drawings, in which:

DETAILED DESCRIPTION OF THE PREFERRED EMBODIMENT

Figure 1:
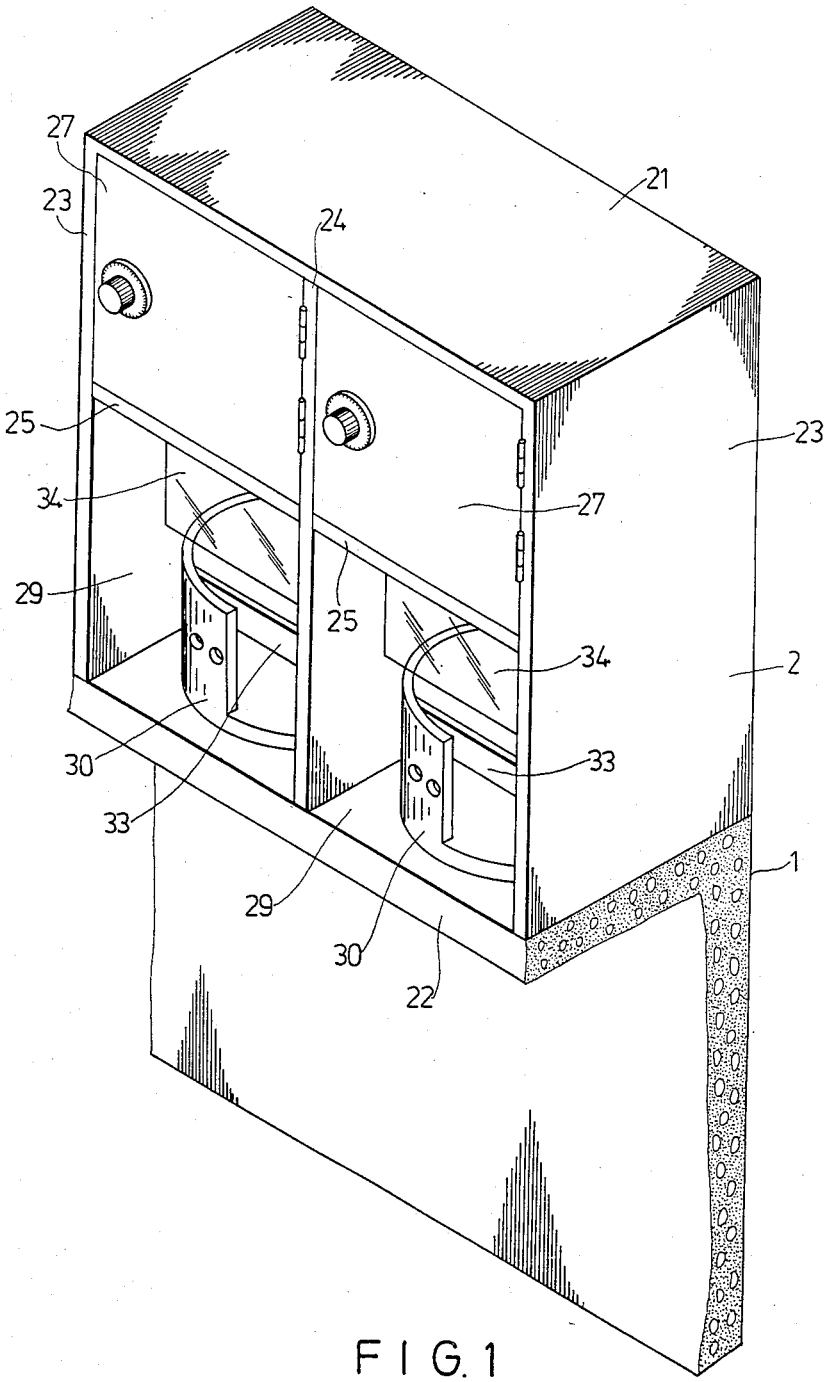
FIG. 1 is a perspective view of a security case embodying the present invention.
Figure 2:
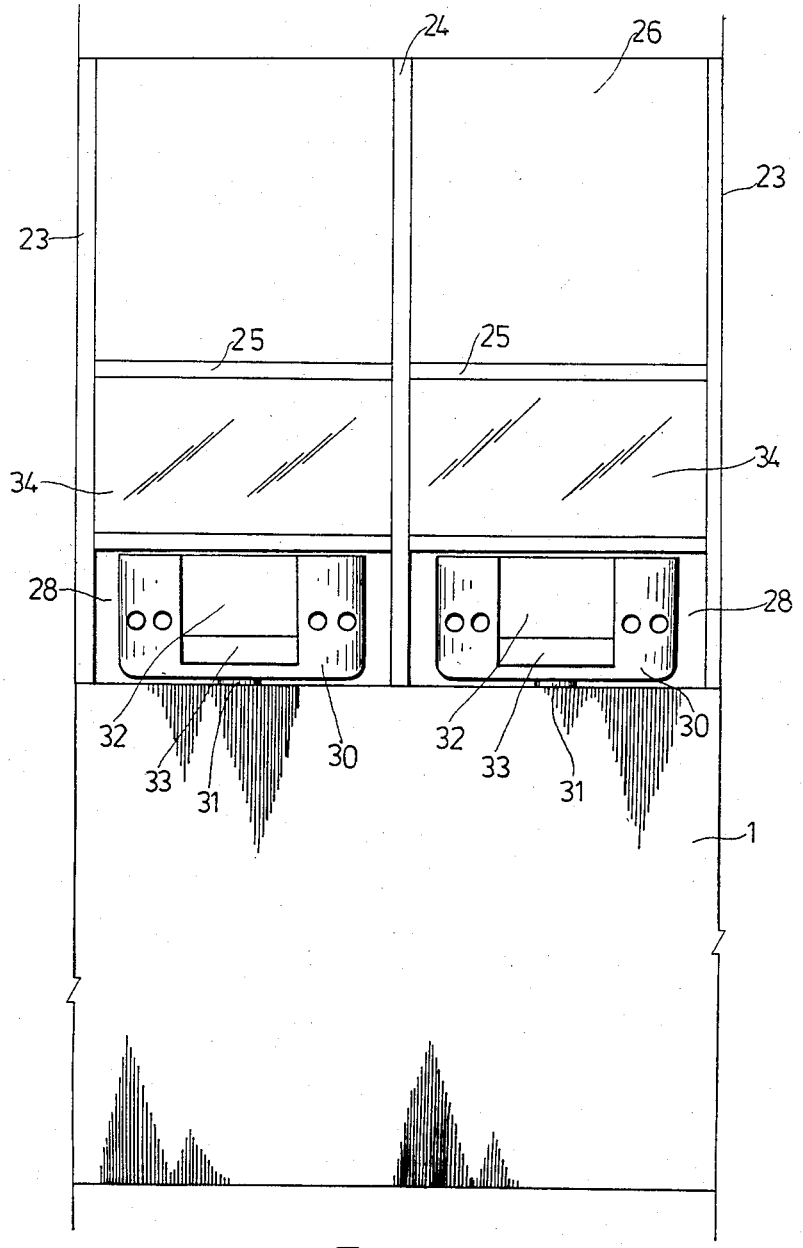
FIG. 2 is a front elevation view of the security case of the same embodiment as FIG. 1.

Referring to FIGS. 1 and 2, there is shown a security case 2 which is disposed on a counter 1. the case 2 is comprised of a top panel 21 and a bottom panel 22 which are interconnected by two vertical side panels 23. A vertical partition member 24 divides the case 2 into two regions, and in each region, a shelf 25 is provided. Each compartment which is confined by top panel 21, shelf 25, one of the side panels 23 and partition member 24 is closed at the front side of the case by a front panel 26 and at the rear side of the case 2 by a rear door 27. Two front openings 28 and two rear openings 29 are defined, at the front side and the rear side of the case 2, by shelves 25, side panels 23, bottom panel 22 and partition member 24.

Two cylindrical containers 30 are mounted on the bottom panel 22 for rotation about vertical shaft 31 on two sides of the partition member 24, each container 30 having a bottom and a cylindrical wall which is provided with two access openings 32 at diametrically opposite positions. A partition member 33 is provided in each container 30 between the openings 32 for dividing the container 30 into two regions. The top side of each of the containers 30 is open and is spaced apart from the bottom side of each shelve 25. Two transparent covers 34, which are preferably made of bullet-proof glass, are disposed between the top side of containers 30 and shelves 25.

It can be appreciated that, when the case 2 is placed on a counter, it can prevent an attack by a person outside the counter on an official. The closed compartments at the upper portion of the case can be used as security closets and the rotary containers 30 at the lower portion of the case can be used for receiving banking documents of the customer, such as deposit certificates, deposit pass books, cash, check etc. for the transaction with the bank official. The partition member in the container 30 may prevent the random movement of the documents in the container. The customer may put the documents in one of the regions of the container 30 through one of access openings 33 from the front side of the case 2 and the bank official may take the documents out from the container 30 after turning the container 30 until the access opening 33 reaches him. The transparent covers 34 allow the official to see the customer therethrough.

With the invention thus explained, it is apparent that various modifications and variations can be made without departing from the scope of the invention. It is therefore intended that the invention be limited as indicated in the appended claims.

What is claimed is:

1. A security case used on a counter comprising:

a housing having a top panel, a bottom panel, two vertical side panels interconnecting said top and bottom panels, at least one shelf disposed between said top and bottom panels, at least one front panel connected to said top panel, said side panels and said shelf for covering the front side of the upper portion of said housing above said shelf, and at least one door means for covering the compartment confined by said top panel, said side panels, said shelf and said front panel disposed at the rear side of said housing, wherein said shelf, said bottom panel and said side panels define a front opening at the front side of said housing and a rear opening in alignment with said front opening at the rear side of said housing;

at least one container mounted in said housing for rotation about a vertical axis between said front and rear openings, said container having at least one access opening; and a transparent cover means disposed in said housing for covering at least one portion of said front opening or said rear opening.

2. A security case as claimed in claim 1, in which said container is mounted on said bottom panel and has a bottom and a cylindrical wall, said wall being provided with two diametrically opposite access openings and a diametral cross partition member between said access openings, wherein the top side of said container is spaced apart from the bottom side of said shelf and said transparent cover is disposed between said shelf and the top side of said container.

3. A security case as claimed in claim 2, wherein said housing further includes a vertical partition panel between said side panels, the top edge and the bottom edge of said partition panel being connected to said top panel and said bottom panel respectively.

* * * * *